United States Patent [19]

Manshausen et al.

[11] 4,227,873

[45] Oct. 14, 1980

[54] KILN WITH OVERLYING BEDS

[75] Inventors: Theodor Manshausen, Cologne; Walter Fritsch, Bergisch Gladbach, both of Fed. Rep. of Germany

[73] Assignee: Klöckner-Humboldt-Wedag AG, Fed. Rep. of Germany

[21] Appl. No.: 966,665

[22] Filed: Dec. 5, 1978

[30] Foreign Application Priority Data

Dec. 9, 1977 [DE] Fed. Rep. of Germany ..... 2754844

[51] Int. Cl.[3] ..... F27B 9/02

[52] U.S. Cl. ..... 432/131; 432/139; 432/151

[58] Field of Search ..... 432/131, 132, 139, 142, 432/151

[56] References Cited

U.S. PATENT DOCUMENTS

| | | | |
|---|---|---|---|
| 1,603,442 | 10/1926 | Balz | 432/131 |
| 2,471,882 | 5/1942 | Martin | 432/131 |
| 3,419,254 | 12/1968 | Von Dreusche, Jr. | 432/131 |

*Primary Examiner*—John J. Camby

*Attorney, Agent, or Firm*—Hill, Van Santen, Steadman, Chiara & Simpson

[57] ABSTRACT

A novel kiln with overlying beds arranged about a central hollow shaft carrying rabble arms attached thereto and with alternate apertures formed in the floors between adjacent stories adjacent the hollow shaft and adjacent the periphery of the floor and with treatment gases being supplied through such orifices in a direction opposite to the direction in which the material moves through a furnace and further providing hot gas feed conduits located in the walls of the furnace in one or more stories and directed in a generally tangential direction relative to the story floors.

4 Claims, 3 Drawing Figures

FIG.1
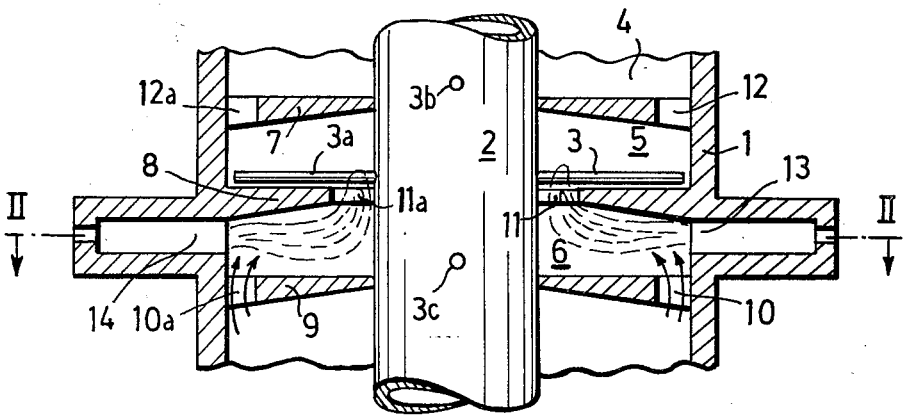
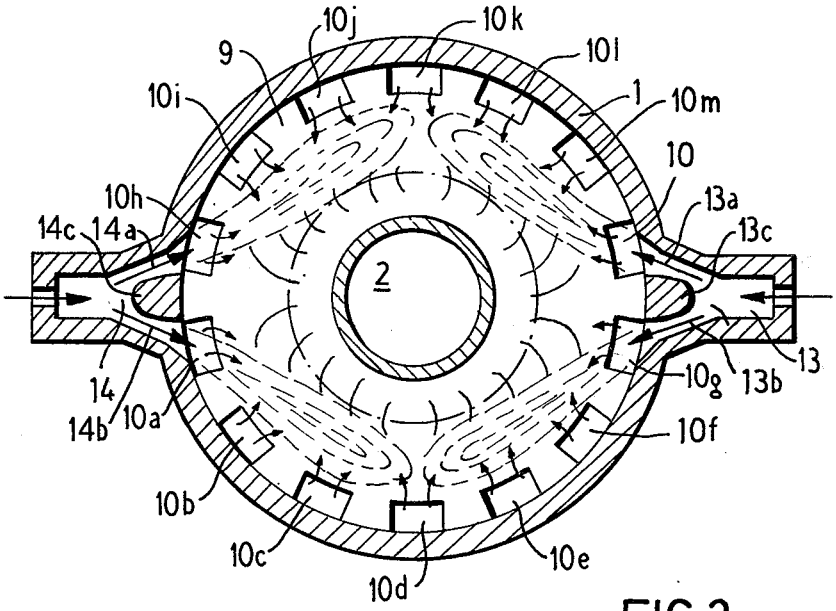
FIG.2

KILN WITH OVERLYING BEDS

BACKGROUND OF THE INVENTION

1. Field of the Invention

This invention relates in general to kilns having overlying beds with a centrally arranged hollow shaft and rabble arms attached thereto.

2. Description of the Prior Art

German laid open specification number 2,529,847 discloses a known kiln with overlying beds for the thermal treatment of slurry type material with the upper most story constructed as a spray chamber with nozzles arranged in the walls with spacings from the floor of such story. In the lower portion of the walls of this spray chamber, nozzles are provided for supplying hot gases into each story.

SUMMARY OF THE INVENTION

The present invention provides a kiln having overlying beds with centrally arranged hollow shafts and rabble arms with apertures arranged alternately centrally in the story floors and on the periphery between adjacent stories and treatment gases are supplied in a direction opposite to the floor of the material to the furnace through such apertures. Adjacent the furnace walls in one or more of the stories are provided hot gas feed conduits through which the hot gases are introduced into the furnace and the direction of introduction of said hot gases is in a generally tangential direction.

Other objects, features and advantages of the invention will be apparent from the following description of certain preferred embodiments thereof taken in conjuction with the accompanying drawings, although variations and modifications may be effected without departing from the spirit and scope of the novel concepts of the disclosure and in which:

BRIEF DESCRIPTION OF THE DRAWINGS

FIG. 1 is a vertical sectional view through a kiln having overlying beds or stories illustrating two hot gas supply conduits arranged on opposite diametric sides of the furnace;

FIG. 2 is a sectional view taken on line II-II from FIG. 1; and

DESCRIPTION OF THE PREFERRED EMBODIMENTS

Figure 3:
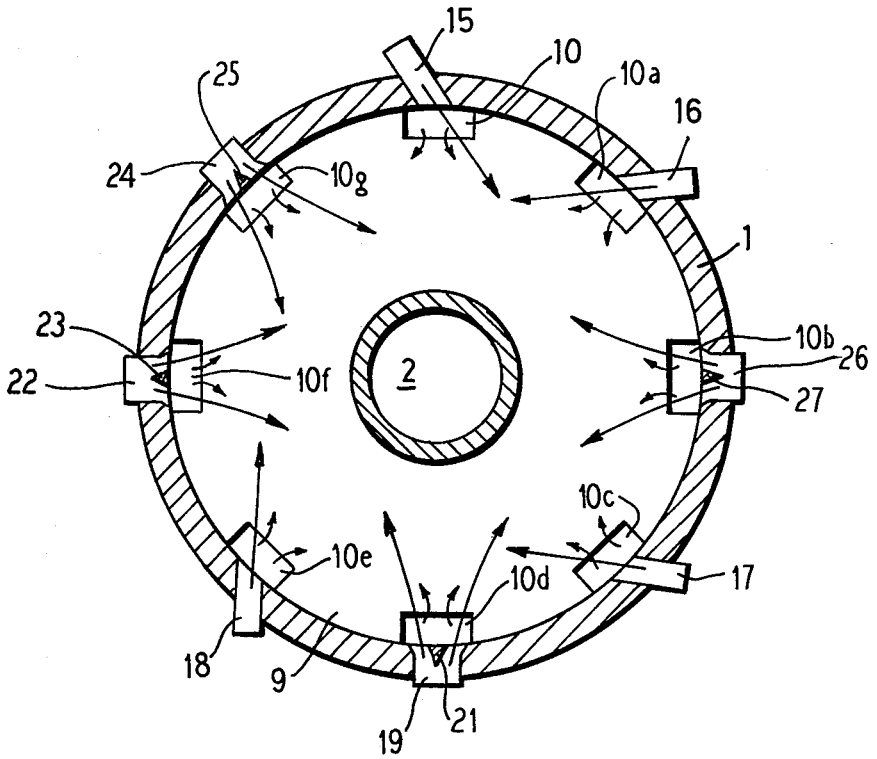
FIG. 3 is a sectional view through the furnace illustrating a modification of the furnace with several hot gas supply conduits arranged oppositely to one another in a story of the kiln.

In a kiln having a plurality of stories with apertures formed therein such that the material can pass through the furnace treatment gases are supplied up through the furnace in a direction opposite to the movement of the material through the furnace and at least two tangentially directed hot gas feed means are provided in one or more stories of the furnace to cause mixing of the reaction treatment gases and the hot gases and to provide an upwardly directed helically shaped extending gas flow which retards the dropping movement of the slurry type material so that the solid particles present in the slurries arrive at the uppermost story floor in the form of dust.

In the present invention, an intensive innermixture of the hot gases with the treatment gases rising in the kiln occur. The present invention solves this problem in that the hot gas feed conduits discharge above the openings in a particular story on the periphery and the orifices of at least two of the gas supply conduits are arranged substantially opposite to one another in the furnace walls structure. Thus, according to the invention, the hot gas supply conduits empty hot gas above the openings in the story which are formed about the periphery of the story floor and the hot gas directly upon entry into the story of the furnace come together with the treatment gases which move upwardly through the orifices in the story floors and the two gases intermix. Also, according to the invention, the openings in each case of two hot gas supply conduits in the furnace wall structure are arranged directly opposite and essentially tangentially to the outer wall of the furnace and to each other so as to provide an intensive innermixture of the hot gases with the treatment gases in a particular story of the furnace and this innermixture extends over the entire story. In this manner, very advantageously the material to be treated as well as the rabbling and the interior masonry of the furnace having overlying beds or stories are protected from local overheating and a uniformed gas temperature is attained which provides favorable reactions in the furnace. The operation and efficiency of the kiln having overlying beds is substantially improved relative to previously known kilns utilizing overlying beds or stories.

FIG. 1 is a partial sectional view trhough a kiln with overlying beds or stories illustrating two hot gas supply conduits 13 and 14 mounted on opposite sides of the furnace walls. As is well illustrated in FIGS. 1 and 2, a centrally mounted hollow shaft 2 has a plurality of rabble arms 3 and **3*a* and 3*b* and 3*c* which are attached to the hollow shaft 2. Stories or beds designated by 4, 5 and 6 as illustrated in FIG. 1 are respectively provided with floors 7, 8 and 9, respectively. The floor 7 is formed with openings 12 and 12*a* arranged about the periphery of the floor 7 adjacent the wall 1 of the furnace. The alternate floor 9 is also provided with a plurality of openings 10 and 10*a* through 10*m* formed about the outer periphery of the floor 9 adjacent the wall 1 of the furnace. The intermediate floor 8 is formed with openings 11 and 11*a* which are adjacent the shaft 2 as illustrated in FIG. 1. Thus, as seen in FIG. 1, the gases must pass from the outer periphery of one floor to the inner periphery adjacent the shaft 2 in the next floor and then again to the outer periphery adjacent the wall 1 in the next succeeding higher floor to pass upwardly through the furnace. This allows the treatment gases to be guided from the lower part of the furnace upwardly in the counter-current direction to the materials which are passing down through the furnace through the openings 10, 11 and 12. In the wall of the kiln 1 are formed hot gas supply conduits 13 and 14 as illustrated in FIGS. 1 and 2 and as the gases enter into the furnace dividing partitions 14*c* and 13*c* divide the gas flow from the supply conduits 13 or 14 so that they pass through orifices 13*a*, 13*b*, 14*a* and 14*b* which direct them generally tangentially into the furnace between the floors 8 and 9 as illustrated in FIG. 1**.

This provides the very advantageous result that the streams of hot gases supplied in on both sides of the kiln in a generally tangential direction are brought directly in contact with the treatment gases which are rising upwardly out of the openings 10 and **10*a* through 10*m* of the kiln floor 9 and, thus, intermix in an intimate fashion with this gas. This manner of mixing and impinging on top of one another of the streams of hot gas which are guided tangentially on both sides of the central area of the kiln or furnace causes an additional intensive intermixture of the hot gases with the reaction gases before the reaction gases rise through the central openings 11 and 11***a* in the kiln floor 8 into the next higher story or bed. The result is that local overheating of the treatment material or roasting charge and of the furnace masonry is prevented. In addition, the intensive innermixture of the hot gases with the reaction gases provides a uniform temperature distribution over the entire story or bed but also results in an increased efficiency and effectiveness of the furnace or kiln. The invention allows better control to be obtained with the kiln over kilns of the prior art of the reaction processes taking place in the furnace or kiln as well as a better utilization of the reduction means and results in savings of investments and operating costs.

It is to be particularly noted relative to FIG. 2 that the gases from the burner 14, for example, do not flow directly toward the center column 2 but flow in a tangential direction as shown by the arrow in the passage way 14*a* and is indicated by the dashed representation of the gases flowing from this passage such that the gases flow from orifice 14*a* generally toward the opening 10*k* in the floor of the wall 9. Likewise, the gas is flowing through the orifice 14*b* flow generally toward the orifice 10*d* in the floor 9. Likewise, the gases flowing through the orifice 13*a* flow generally toward the orifice 10*k* and the gases flowing through the orifice 13*b* flow generally toward the orifice 10*d*.

FIG. 3 illustrates a modification of the invention wherein hot gas conduits are supplied into the furnace such as illustrated by conduits 15 and 16 which are mounted at an angle through the wall of the kiln 1 and such that the gases emitted from the conduits 15 and 16 are directed toward each other as illustrated in FIG. 3. The openings 10 through 10*g* in the floor 9 are arranged below the hot gas conduit orifices as shown. The hot gas conduit 26 is formed with a dividing partition 27 which directs gas in opposite directions and tangentially of the wall of the kiln 1 over the opening 10*b*. The gas input conduit 17 emits gas over the opening 10*c* in a tangential direction as shown. The conduit 19 is provided with a divider 21 which provides two input gas jets over the opening 10*d*. The hot gas conduit 18 mounted in the wall of the kiln 1 emits gas in a tangential direction as shown over the opening 10*e*. The hot gas opening 22 is formed with a dividing partition 23 which directs the gases generally tangentially of the walls of the kiln 1 over the opening 10*f*. The hot gas conduit 24 is formed with a partition 25 which generally directs the gases tangentially over the opening 10*g* as shown. Thus, in the embodiment illustrated in FIG. 3 the hot gases are directed in different directions, but generally tangentially from the various hot gas conduits so that the hot gases and the reaction gases will be optimally mixed and intermixed and efficient and improved operation of the kiln is obtained. Thus, in the present invention, the construction and arrangement of the hot gas supply conduit in the kiln result in advantageously optimizing reaction in the kiln and in an appreciable improvement of the entire thermal effectiveness of the kiln is obtained.

Although the invention has been described with respect to preferred embodiments thereof, it is not to be so limited as changes and modifications may be made therein which are within the full intended scope of the invention as defined by the appended claims.

We claim as our invention:

1. A kiln with overlying beds, comprising a centrally arranged hollow shaft and rabble arms fixed thereon mounted in the kiln, a plurality of vertically spaced floors mounted in said kiln with alternate floors having pluralities of central openings and the other floors having pluralities of openings on the periphery through which the treatment gases are guided through said plurality of openings in countercurrent to the materials through the kiln, and whereby the kiln wall structure is provided in one or several stories with hot gas supply conduits, through which the hot gases are introduced substantially tangentially of the wall of the kiln into the story characterized in that the hot gas supply conduits (13, 14, 15, 16) empty above the plurality of openings (10) arranged on the periphery in the floor (9) of the story, and that the openings or at least two hot gas supply conduits are arranged in the kiln wall structure substantially opposite to one another.

2. A kiln with overlying beds, according to claim 1, characterized in that the hot gas supply conduits (13, 14) are constructed as branch conduits and are arranged oppositely in the furnace or kiln wall structure opposite to one another.

3. A kiln for processing material with treatment gases and hot gases comprising a generally vertically mounted hollow cylindrical kiln structure having a wall, a center hollow shaft extending upwardly centrally of said hollow cylindrical kiln, a plurality of rabble arms mounted on said center hollow shaft, a plurality of horizontal floors mounted parallel to and above each other in said kiln, alternate ones of said plurality of floors formed with pluralities of openings about their peripheries, the other one of said plurality of floors formed with pluralities of openings about said hollow cylindrical shaft, a first means mounted in the wall of said kiln for directing hot gas into said kiln over one of said openings in the periphery of one of said alternate floors and in a direction generally tangentially to the wall of said kiln.

4. Apparatus according to claim 3 wherein said first means comprises a pair of passages for directing hot gases into said kiln in generally opposite directions each tangentially to the wall of said kiln.

* * * * *